US006481128B1

(12) United States Patent
Lin

(10) Patent No.: US 6,481,128 B1
(45) Date of Patent: Nov. 19, 2002

(54) ORNAMENT SIMULATING DYNAMIC SCENE OF VOLCANIC ERUPTION

(76) Inventor: Ming-Kuei Lin, 17F. No. 309, Sce. 2, Wen Hua Rd., Panchiao, Taipei Hsien (TW)

( * ) Notice: Subject to any disclaimer, the term of this patent is extended or adjusted under 35 U.S.C. 154(b) by 0 days.

(21) Appl. No.: 09/884,061

(22) Filed: Jun. 20, 2001

(51) Int. Cl.[7] ..... G09F 19/00
(52) U.S. Cl. ..... 40/406; 40/407; 446/267
(58) Field of Search ..... 40/406, 407, 409, 40/410; 446/267, 397, 404; 472/65

(56) References Cited

U.S. PATENT DOCUMENTS 3,147,175 A * 9/1964 Gonzalez ..... 472/65
5,313,727 A * 5/1994 Murray, Jr. ..... 40/410
6,332,282 B1 * 12/2001 Lin ..... 40/406
6,415,534 B1 * 7/2002 Liao ..... 40/407

* cited by examiner

*Primary Examiner*—S. Joseph Morano
*Assistant Examiner*—Frantz F. Jules
(74) *Attorney, Agent, or Firm*—Dennison, Schultz & Dougherty

(57) ABSTRACT

An ornament includes a closed showcase in which a liquid and a plurality of granules as well as a model of volcano are provided; a liquid-guiding mechanism provided in a lower part of the showcase to provide a cyclic liquid path for the ornament; and a driving mechanism located below the liquid-guiding mechanism to suck the liquid downward and then force the liquid upward via the liquid-guiding mechanism, so that the liquid carries the granules to repeatedly spout into a conduit in the model of volcano and erupt from a crater of the volcano and then scatter over the liquid-guiding mechanism, creating a dynamic scene similar to a volcanic eruption. A light and sound producing mechanism is mounted in a base of the showcase to produce flashes and sounds corresponding to the scene of volcanic eruption.

1 Claim, 7 Drawing Sheets

ORNAMENT SIMULATING DYNAMIC SCENE OF VOLCANIC ERUPTION

BACKGROUND OF THE INVENTION

The present invention relates to an ornament simulating dynamic scene of volcanic eruption, and more particularly to an ornament that has a showcase in which a liquid and a plurality of granules as well as a model of volcano are provided; a liquid-guiding mechanism provided in a lower part of the showcase to provide a circular liquid path for the ornament; and a driving mechanism sucking the liquid downward and then forcing the liquid upward via the liquid-guiding mechanism, so that the liquid carries the granules to repeatedly erupt from a crater of the volcano, creating a dynamic scene similar to a volcanic eruption.

U.S. Pat. No. 5,426,877 discloses a Dynamic Liquid Display Structure and U.S. patent application Ser. No. 09/559,590 and its corresponding UK Patent Application No. 0010263.2 discloses a Lamp Showing Movable Floating Ornament, both of which are invented by the same inventor of the present invention to create interesting dynamic scenes in a liquid ornament and on a lamp, respectively.

It is now tried by the inventor to make other improvements on the technical mechanism adopted in U.S. Pat. No. 5,426,877 and U.S. patent application Ser. No. 09/559,590, so as to provide another novel ornament that simulates dynamic scene of volcanic eruption.

SUMMARY OF THE INVENTION

A primary object of the present invention is to provide an ornament simulating dynamic scene of volcanic eruption. The ornament mainly includes a closed showcase in which a liquid and a plurality of granules as well as a model of volcano are provided; a liquid-guiding mechanism provided in a lower part of the showcase to provide a circular liquid path for the ornament; and a driving mechanism located below the liquid-guiding mechanism to suck the liquid downward and then force the liquid upward via the liquid-guiding mechanism, so that the liquid carries the granules to repeatedly spout into a conduit in the model of volcano and erupt from a crater of the volcano, creating dynamic scenes similar to a volcanic eruption. The erupted granules scatter over the liquid-guiding mechanism and are ready for a next volcanic eruption. A light and sound producing mechanism is mounted in a base of the showcase to produce flashes and sounds corresponding to the spouted liquid and erupted granules, making the scene of volcanic eruption vivid and attractive.

BRIEF DESCRIPTION OF THE DRAWINGS

The structure and the technical mechanism adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
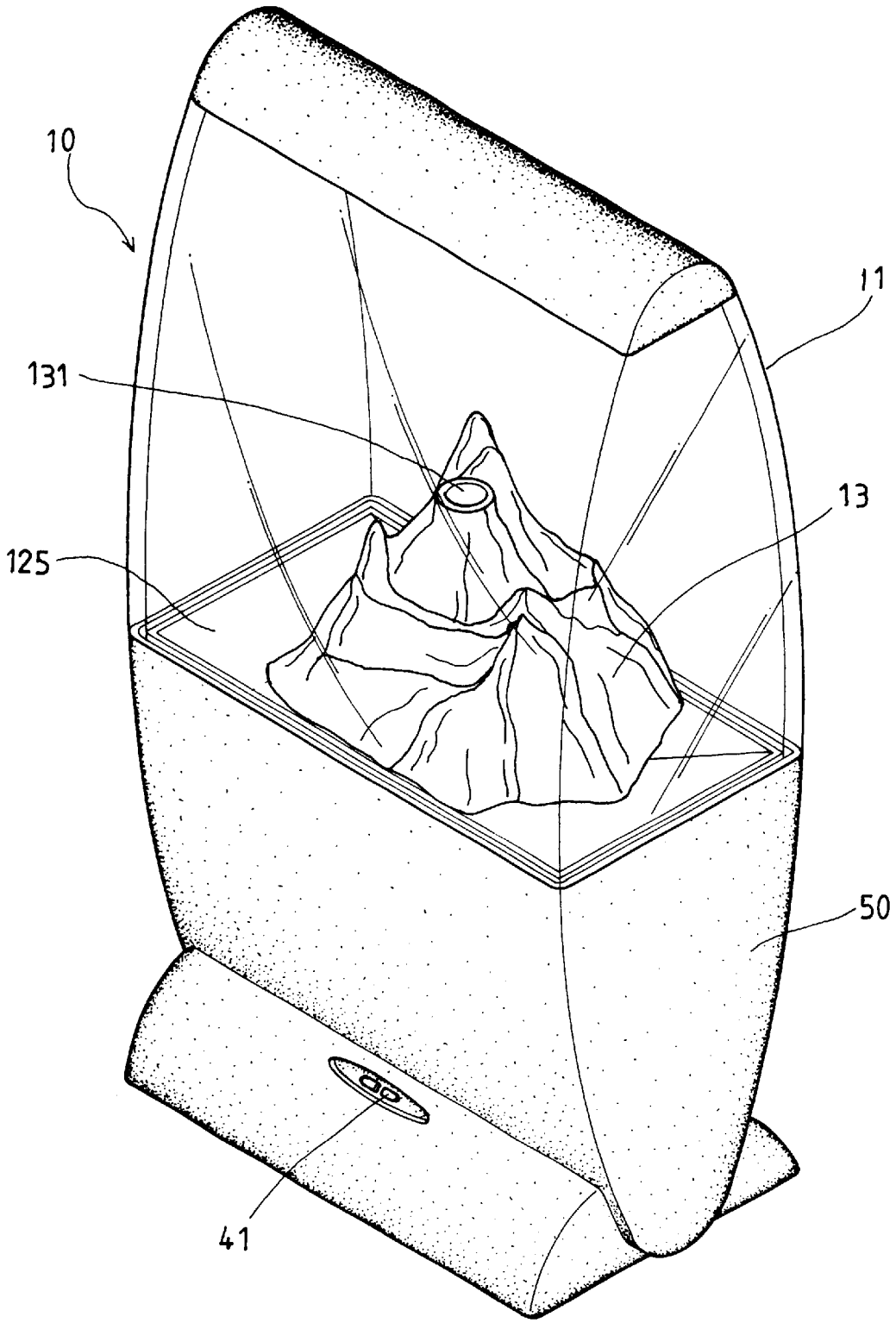
FIG. 1 is a perspective view of an ornament simulating dynamic scene of volcanic eruption according to an embodiment of the present invention, wherein the ornament is in a turned-off state.

Please refer to FIGS. 1 to 5 in which an ornament simulating dynamic scene of volcanic eruption is shown. For the purpose of simplicity, the ornament simulating dynamic scene of volcanic eruption will be referred to as "the ornament" hereinafter.

The ornament of the present invention mainly includes a closed showcase 10, a liquid-guiding mechanism 20, a driving mechanism 30, a light and sound producing mechanism 40, and a base 50 enclosing a lower part of the showcase 10 to support the showcase 10 thereon. The liquid-guiding mechanism 20 and the driving mechanism 30 are generally similar to that employed in the Lamp Showing Movable Floating Ornament disclosed in the above-mentioned U.S. patent application Ser. No. 09/559,590. That is, the driving mechanism 30 is located outside and below a lower part of the closed showcase 10 and mainly includes an electromagnetic coil 31 and other related electronic circuits (not shown). When the electromagnetic coil 31 is supplied with an electric current, a shaft 32 mounted in the lower part of the closed showcase 10 is electromagnetically induced to rotate, causing a centrifugal propeller 33 connected to the shaft 32 to rotate at the same time.

The closed showcase 10 includes a downward reduced lower part 12 that is further divided into an upper chamber 121, a middle chamber 122, and a lower chamber 123. The shaft 32 is received in the lower chamber 123 with the centrifugal propeller 33 located in the middle chamber 122, and the liquid-guiding mechanism 20 is mounted in the upper chamber 121.

The liquid-guiding mechanism 20 mainly includes an upper hollow cone 21, a middle hollow cone 22, and a lower disc 23. The lower disc 23 is connected along its bottom outer periphery to a top inner periphery of the middle chamber 122 to locate above the propeller 33. The lower disc 23 is formed at its vertical peripheral wall with two diametrically opposite and transversely extended through holes 231, and above its bottom with two diametrically opposite and open-topped compartments 233. A radially outer side of each compartment 233 communicates with one of the two through holes 231 and a radially inner side of each compartment 233 is vertical opening 232. The through holes 231, the vertical openings 232 and the compartment 233 together constitute a liquid-in path on the liquid-guiding mechanism 20. Portions on the bottom of the lower disc 23 at two sides of the compartments 233 are provided with two sector-shaped openings 234 that constitute a liquid-out path on the liquid-guiding mechanism 20. The lower disc 23 also has a central horizontal partition 235. A plate 236 is uprightly fixed on a top of the central horizontal partition 235 to divide liquid upward flowing through the lower disc 23 into two separated flows.

The middle hollow cone 22 is connected to the top of the lower disc 23 and has a reduced open top and an expanded open bottom. Two horizontal walls 221 radially inward extend from a lower outer periphery of the middle hollow cone 22 and are at positions immediately above the two compartments 233 on the lower disc 23 so as to close the open tops of the two compartments 233.

The upper hollow cone 21 is a shallow cone having an expanded open top and a reduced closed bottom. The upper hollow cone 21 is so dimensioned that an upper outer periphery thereof is fitly connected to a middle rim portion 124 of the upper chamber 121 and a lower inner periphery of the upper hollow cone 21 is fitly connected to an upper outer periphery of the middle hollow cone 22. A bottom surface 211 of the upper hollow cone 21 is provided with a plurality of vertically extended spout holes 212. An inclined peripheral wall 213 of the upper hollow cone 21 between the open top and the closed bottom surface 211 thereof is provided with a plurality of vertically extended through holes to serve as liquid inlets 214.

The closed showcase 10 contains a transparent liquid and a plurality of granules 60 and has a model of volcano 13 seated therein. A middle part of the showcase 10 is enclosed with a transparent wall 11 through which an interior of the closed showcase 10 can be seen from outside of the showcase 10. The model of volcano 13 is provided with at least one crater 131 to which an internal conduit 132 is connected. The conduit 132 has a funnel-shaped lower opening 133.

The upper chamber 121 of the lower part of the showcase 10 has a middle rim portion 124, from where an upper peripheral wall portion 125 upward flares to end at a lower edge of the transparent wall 11. The middle rim portion 124 and the flared peripheral wall portion 125 may have different shapes to give the showcase 10 different appearances.

The bottom surface 211 of the upper hollow cone 21 is provided at a center with an upward extended conic guide tube 215 to replace one of the spout holes 212, so that a top opening of the conic guide tube 215 is pointed toward the funnel-shaped lower opening 133 and the conduit 132 to speed up the liquid spouted into the conduit 132 and the granules 60 erupted from the crater 131.

Figure 2:
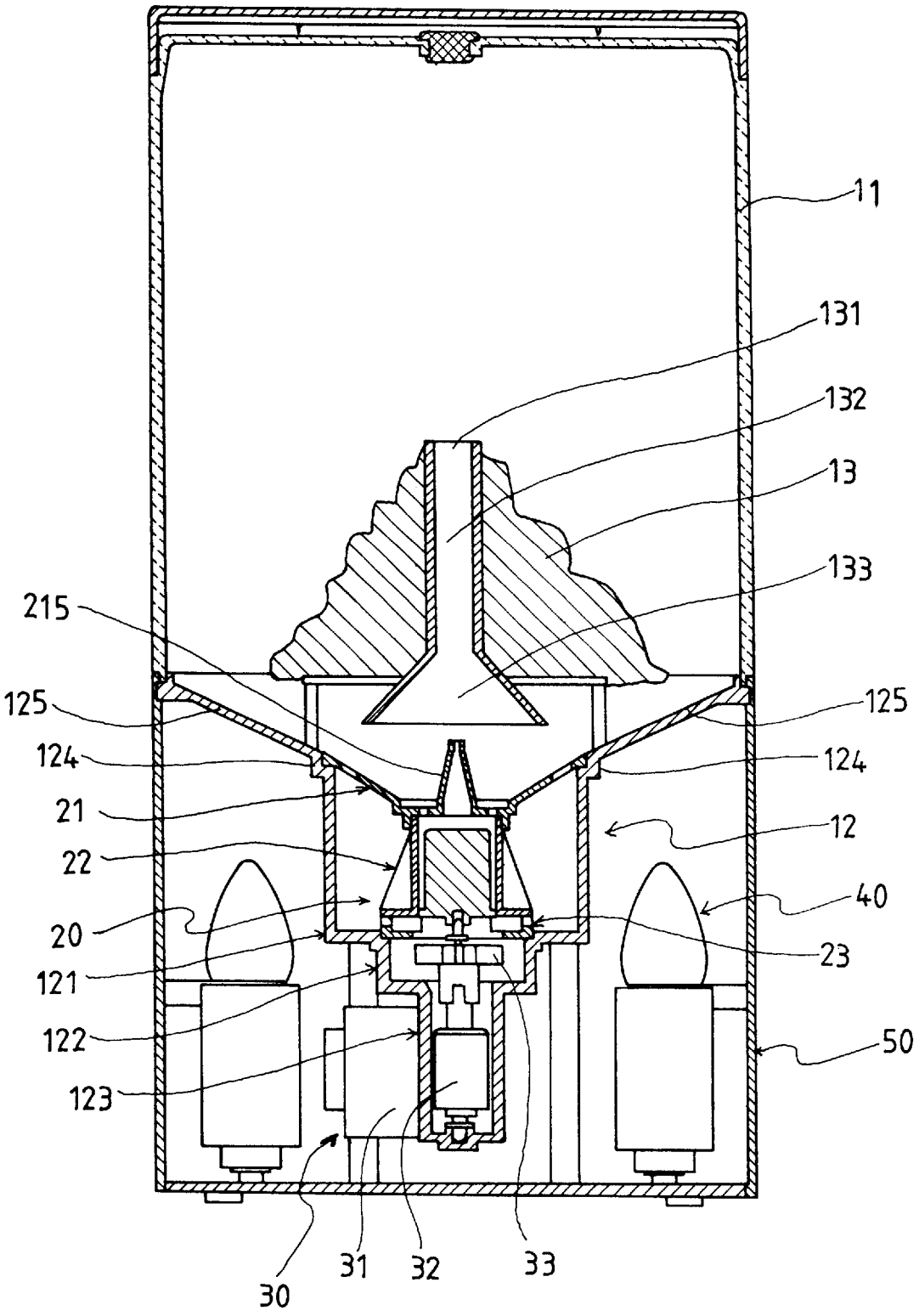
FIG. 2 is a vertical sectioned view of the ornament of FIG. 1 showing a structure thereof.
Figure 3:
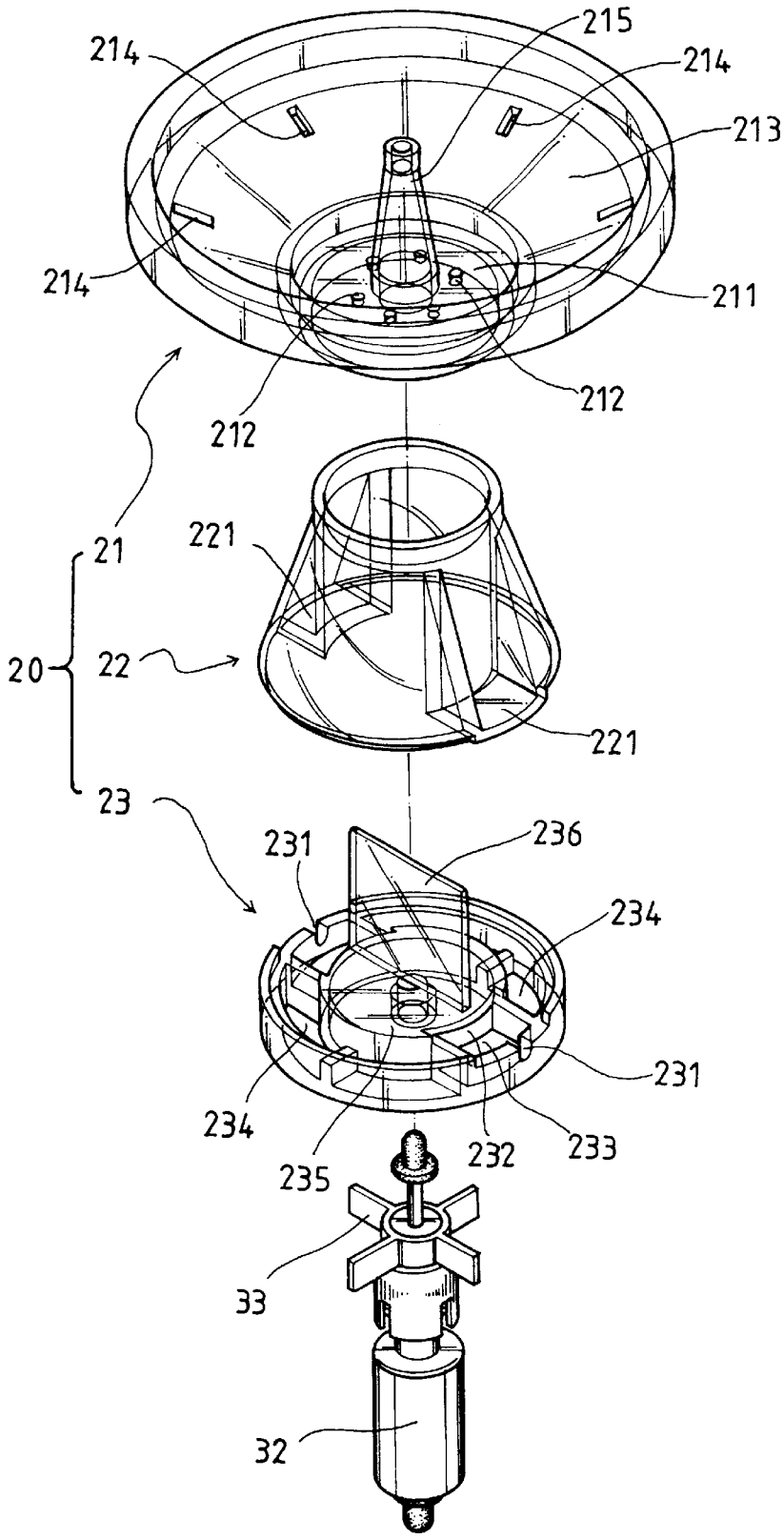
FIG. 3 is an exploded perspective view of a liquid-guiding mechanism provided at a lower part of the ornament of FIG. 1.
Figure 5:
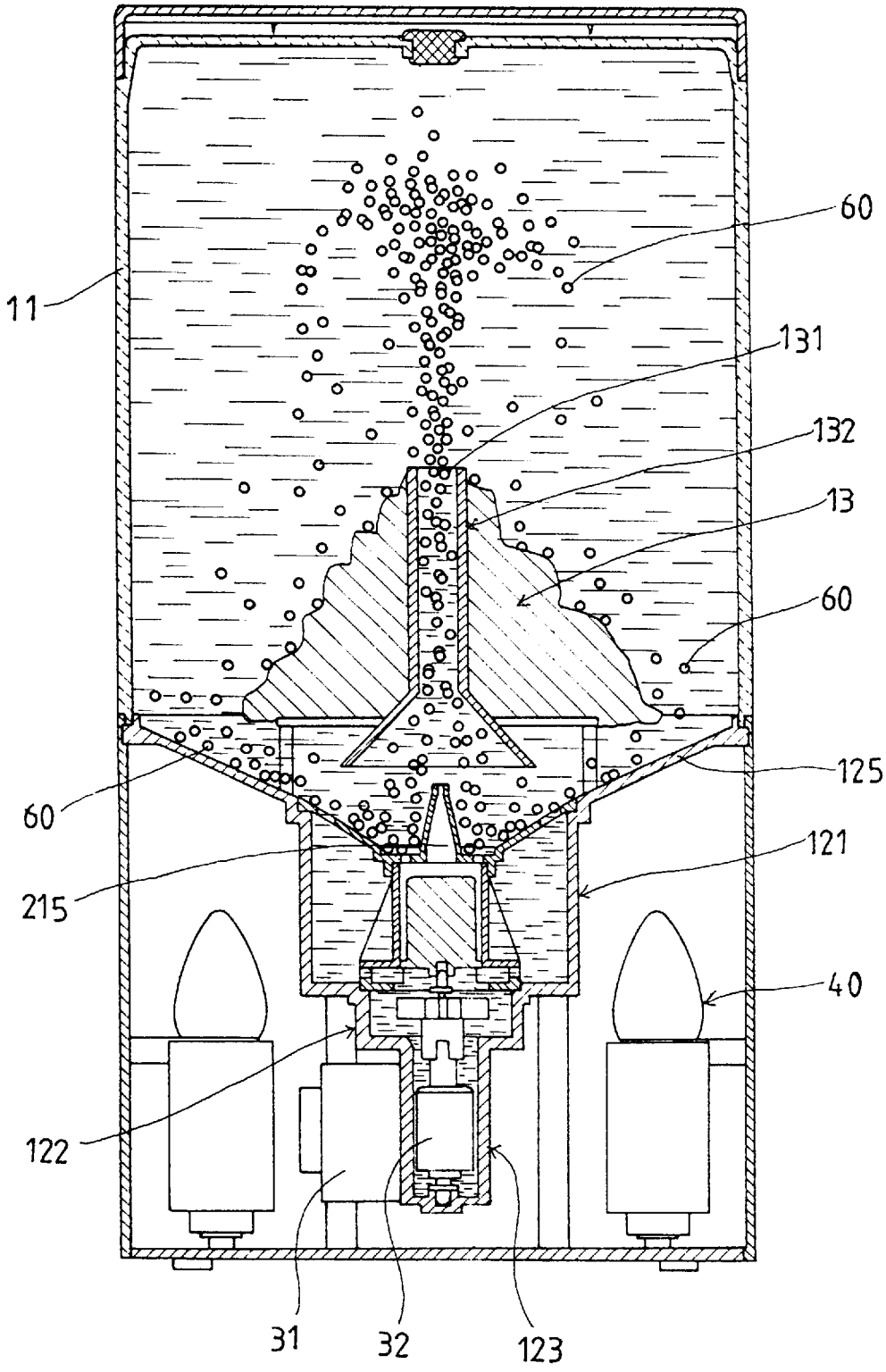
FIG. 5 is a vertical sectioned view of the ornament of FIG. 4.

The light and sound producing mechanism 40 is located in the base 50 (in FIGS. 2 and 5, only lighting-emitting elements of the light and sound producing mechanism 40 are shown). An externally accessible switch 41 is provided on the base 50 for easily controlling an operation of the light and sound producing mechanism 40 corresponding to a dynamic scene of volcanic eruption created by the granules 60 continuously spouted into the middle transparent part of the showcase 10 from the crater 131. The granules 60 have diameters larger than that of the spout holes 212 and the liquid inlets 214 on the upper hollow cone 21, 30 that they do not fall into the middle hollow cone 22 from the upper hollow cone 21.

Figure 6:
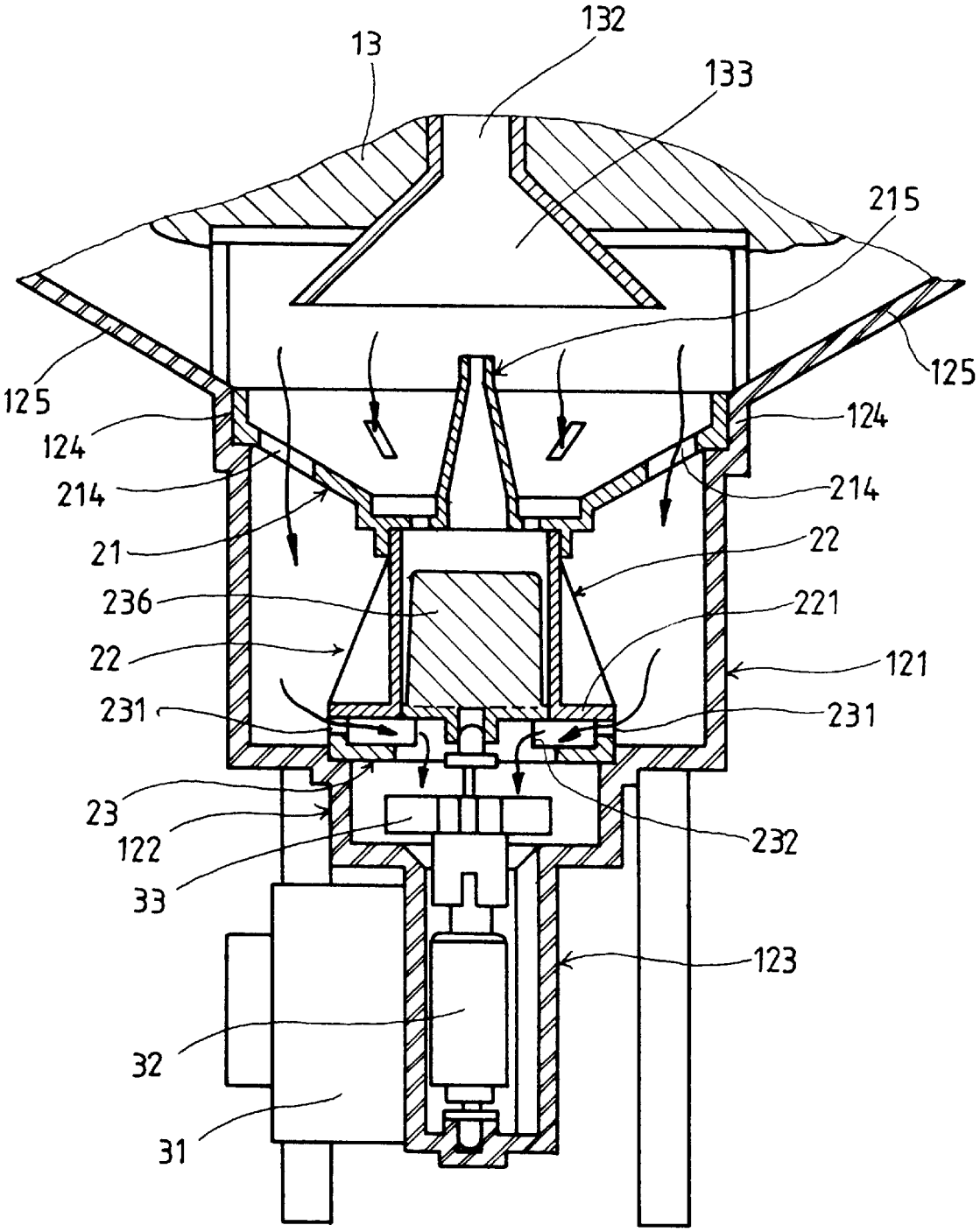
FIG. 6 shows paths along which liquid flows into the liquid-guiding mechanism of the ornament of FIG. 1.

Please now refer to FIG. 6 in which thick arrows are used to indicate paths along which liquid in the ornament of the present invention flows into the liquid-guiding mechanism 20. As show, the liquid flows into the upper chamber 121 via the liquid inlets 214 on the upper hollow cone 21 and passes through the through holes 231 on the lower disc 23. Being stopped by bottoms of the compartments 233 of the lower disc 23 and the horizontal walls 221 of the middle hollow cone 22, the liquid passing through the through holes 231 could only flow down into the middle chamber 122 via the vertical openings 232. When the centrifugal propeller 33 is turned on, liquid is first sucked into and then forced out of the middle chamber 122.

Figure 4:
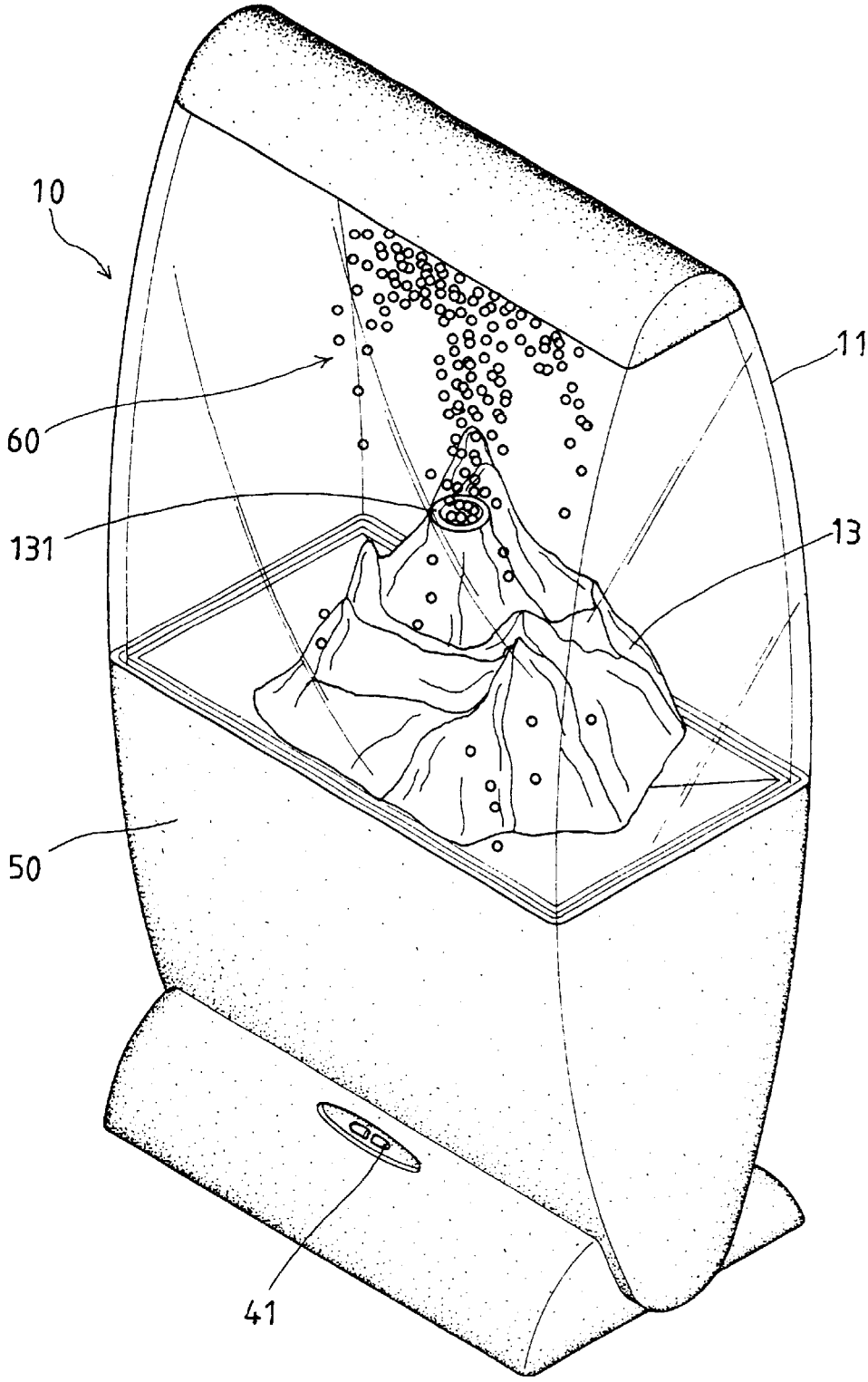
FIG. 4 is a perspective view of the ornament of FIG. 1 in a turned-on state to create a scene of volcanic eruption.
Figure 7:
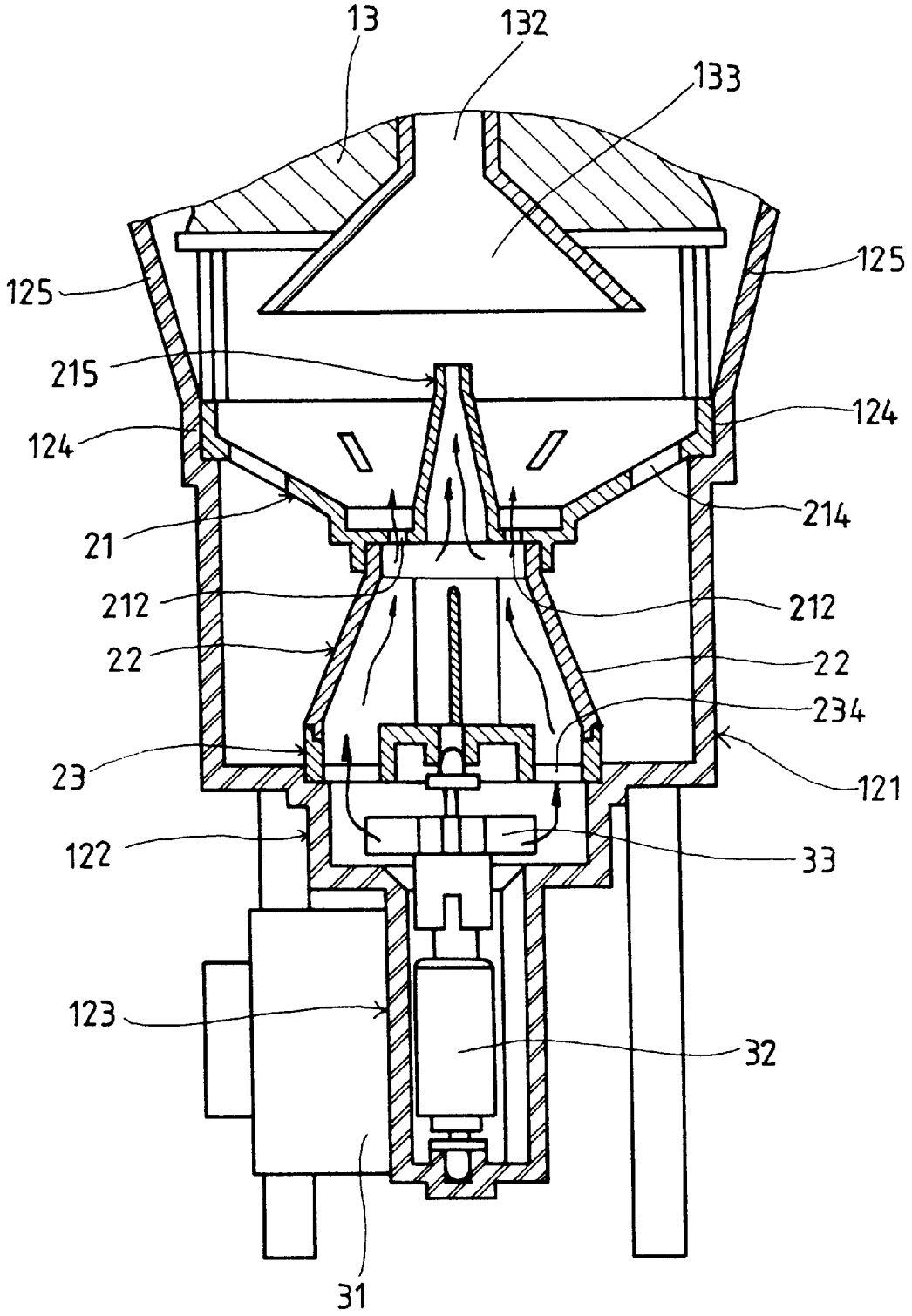
FIG. 7 shows paths along which liquid flows out of the liquid-guiding mechanism of the ornament of FIG. 1.

In FIG. 7, thick arrows are used to indicate paths along which liquid flows out of the liquid-guiding mechanism 20 into the middle transparent portion of the showcase 10. As shown in FIG. 7, when the propeller 33 is turned on to force out liquid in the middle chamber 122, the liquid is stopped by a peripheral wall of the middle chamber 122, the bottoms of the compartments 233 and the central top partition 235 of the lower disc 23, and could only move upward to spout from the sector-shaped openings 234 on the lower disc 23 and enter into the middle hollow cone 22. The liquid in the middle hollow cone 22 keeps flowing upward to spout from the small spout holes 212 and the conic guide tube 215 on the bottom surface 211 of the upper hollow cone 21 at an increased speed, bringing the granules 60 fallen on the bottom surface 211 to continuously move through the funnel-shaped opening 133 and the conduit 132 before being erupted from the crater 131, as shown in FIG. 4, just like a scene of volcanic eruption. The granules 60 erupted from the crater 131 scatter over the flared peripheral wall portion 125 of the upper chamber 12 and the inclined peripheral wall 213 of the upper hollow cone 21 and finally fall to the central bottom surface 211 of the upper hollow cone 21, as shown in FIG. 5. Meanwhile, the liquid cycles in the closed showcase 10 to produce repeatedly erupted granules 60 from the crater 131.

What is claimed is:

1. An ornament simulating dynamic scene of volcanic eruption, comprising a closed showcase, a liquid-guiding mechanism, a driving mechanism, a light and sound producing mechanism, and a base enclosing a lower part of said showcase to support said showcase thereon;

said showcase being a case of any shape for containing a transparent liquid and a plurality of granules therein; said showcase including a middle part enclosed by a transparent wall through which an interior of said showcase could be seen from outside of said showcase, a model of volcano being seated in said middle portion and having at least one crater to which a conduit having a funnel-shaped lower opening is connected; and said showcase also including a lower part supported on said base and divided into an upper, a middle, and a lower chamber, said upper chamber having a middle rim portion, from where an upper peripheral wall portion upward flares to end at a lower edge of said transparent wall of said middle part of said showcase;

said liquid-guiding mechanism being located in said upper chamber of said lower part of said showcase and including an upper hollow cone, a middle hollow cone, and a lower disc; said lower disc being connected along its bottom outer periphery to a top inner periphery of said middle chamber and being provided with separated liquid-in and liquid-out paths; said middle hollow cone being connected to a top of said lower disc and having a reduced open top and an expanded open bottom; said upper hollow cone being fitly connected at an upper edge to said middle rim portion of said upper chamber and at a lower inner periphery to an upper outer periphery of said middle hollow cone; said upper hollow cone being provided at a bottom surface with a centered conic guide tube upward pointed toward said funnel-shaped lower opening and said conduit and a plurality of vertically extended spout holes around said guide tube, and at an inclined peripheral wall surrounding said bottom surface with a plurality of vertically extended liquid inlets;

said driving mechanism including an electromagnet coil located outside said lower chamber of said lower part of said showcase, a shaft mounted in said lower chamber, and a propeller connected to said shaft and located in said middle chamber of said showcase; said electromagnetic coil, when being supplied with an electric current, electromagnetically inducing said shaft and accordingly said propeller to rotate, such that said liquid in said showcase is sucked down into said middle chamber via said liquid inlets on said upper hollow cone and then forced out of said middle chamber to flow into said conduit via said spout holes and said conic guide tube on said upper hollow cone to spout from said crater on said model of volcano, forming a circular liquid path in said ornament; and said light and sound producing mechanism being mounted in said base to locate outside said lower chamber of said showcase, and being controllable via an externally accessible switch provided on said base to produce flashes and specially designed sounds corresponding to said cyclic and spouted liquid; and said granules being carried by said cyclic liquid to continuously move through said funnel-shaped opening and said conduit before being erupted from said crater, just like a scene of volcanic eruption, and then scattering over said flared peripheral wall portion of said upper chamber and said inclined peripheral wall of said upper hollow cone and finally falling to said central bottom surface of said upper hollow cone again to be repeatedly erupted from said crater.

* * * * *